United States Patent [19]

Muschalik

[11] Patent Number: 4,836,163

[45] Date of Patent: Jun. 6, 1989

[54] THROTTLE-BUTTERFLY CONNECTOR PIECE FOR AN INTERNAL COMBUSTION ENGINE

[75] Inventor: Gerald Muschalik, Frankfurt am Main, Fed. Rep. of Germany

[73] Assignee: VDO Adolf Schindling AG, Frankfurt am Main, Fed. Rep. of Germany

[21] Appl. No.: 135,659

[22] Filed: Dec. 21, 1987

[30] Foreign Application Priority Data

Dec. 22, 1986 [DE] Fed. Rep. of Germany ..... 3643948

[51] Int. Cl.[4] ..... F02D 9/10; F02M 3/08

[52] U.S. Cl. ..... 123/337; 137/630.15; 137/630.2; 137/630.21

[58] Field of Search ..... 123/336, 337; 137/599.2, 630, 630.15, 630.19, 630.2, 630.21

[56] References Cited

U.S. PATENT DOCUMENTS

| | | | |
|---|---|---|---|
| 2,035,191 | 3/1986 | Reynolds | 137/559.2 |
| 4,344,396 | 8/1982 | Yamada | 123/337 |
| 4,408,581 | 10/1983 | Pfalzgrat et al. | 123/339 |

FOREIGN PATENT DOCUMENTS

| | | | |
|---|---|---|---|
| 281542 | 1/1915 | Fed. Rep. of Germany . | |
| 2950866 | 6/1981 | Fed. Rep. of Germany | 123/337 |
| 146029 | 11/1981 | Japan | 123/337 |
| 202338 | 11/1983 | Japan | 123/336 |
| 1183813 | 3/1970 | United Kingdom . | |

*Primary Examiner*—Tony M. Argenbright
*Attorney, Agent, or Firm*—Martin A. Farber

[57] ABSTRACT

In the throttle butterfly (2) of a throttle-butterfly connector piece of an internal combustion engine there is provided an expansion member (5) which has two arcuate pieces (6,7) which extend out of the circumferential surface of the throttle butterfly (2). The free ends of the arcuate pieces (6, 7) rest against a setting surface (8) which is provided on the housing (1) of the throttle-butterfly connector piece. The setting surface (8) is developed in such a manner that the arcuate piece (6, 7) is spread and the surface of the throttle butterfly (2) is increased with small angles of opening as compared with what it is in its closed condition.

6 Claims, 2 Drawing Sheets

THROTTLE-BUTTERFLY CONNECTOR PIECE FOR AN INTERNAL COMBUSTION ENGINE

FIELD AND BACKGROUND OF THE INVENTION

The present invention refers to a throttle-butterfly connector piece for an internal combustion engine which connector piece has a throttle butterfly which can be turned by a setting shaft which is passed through a setting-shaft passage into the throttle-butterfly connector piece. Such throttle-butterfly connector pieces are provided in the internal combustion engines of modern automotive vehicles and are generally known.

In modern automotive vehicles the idling speed of rotation is not simply set to a given value for an average load but is adjusted by means an electronic regulator to a desired value which lies under all conditions of load only slightly above the stalling point of the engine. In this way the consumption of fuel and the contaminating of the environment by injurious exhaust gas are reduced.

In throttle-butterfly connector pieces with throttle butterfly it is disadvantageous for such idling speed adjustments that the free air-passage cross section of the throttle-butterfly connector piece increases very rapidly at the start of the opening of the throttle butterfly even with only small angles of opening of the throttle butterfly. Since the throttle butterfly is not suitable for this reason as setting member for the adjustment of the idling speed, modern idling speed controls contain a bypass which bypasses the throttle butterfly and within which an idling speed setter is arranged as setting member. This naturally results in a considerable expense, with the result frequently that the entire idling speed control is considered too expensive.

SUMMARY OF THE INVENTION

It is an object of the invention to develop a throttle-butterfly connector piece of the aforementioned type that with small angles of opening a sensitive regulating of the throughput of air is possible by displacement of the throttle butterfly.

According to the invention, an expansion member (5) is arranged in the region of the edge of the throttle butterfly (2), said member being capable upon the opening of the throttle butterfly (2) to move out of the edge of the throttle butterfly (2) as a function of the angular position of the throttle butterfly (2).

By this simple development of the throttle-butterfly connector piece the area of the throttle butterfly which throttles the cross section of the throttle-butterfly connector piece changes upon the swinging of the throttle butterfly. The undesired effect present in the previous throttle butterflies, namely that the free cross section increases greatly even for small angles of opening, is avoided by the fact that, due to the invention, with small opening angles the throttle butterfly increases in cross section as compared with its closed position. By this development of a throttle butterfly it is possible to dispense with a bypass with idling-speed setter as setting member for an idling speed control.

The throttle-butterfly connector piece of the invention is particularly simple in construction if the expansion member (5) is a spring cuff which rests via two arcuate pieces (6, 7), which can move out of the edge of the throttle butterfly against a setting surface (8) of the housing (1) of the throttle-butterfly connector piece.

The setting surface can also be produced in very simple manner if the setting surface (8) is arranged, coaxial to the setting valve passage (4) on the inside within the throttle-butterfly connector piece.

The expansion member is of simple development and can be easily attached to the throttle butterfly if, in accordance with another advantageous embodiment of the invention, the expansion member (5) consists of an inner, not closed, ring-shaped body (12) which is fastened on the throttle butterfly (2), two expansion-body arms (15, 16) extending radially outward from the free ends of the ring-shaped member, an arcuate piece (6, 7) which extends along the edge of the throttle butterfly (2) and rests against the setting surface (8) adjoining each of said arms.

It is also advantageous for the expansion member (5) to have a cross section which differs over its circumference. In this way one can determine, in the manner desired in each case, by the bend line of the expansion member how the expansion member deforms upon a swinging movement of the throttle butterfly and thus moves outward upon the opening of the throttle butterfly.

The invention permits of numerous embodiments.

BRIEF DESCRIPTION OF THE DRAWINGS

With the above and other objects and advantages in view, the present invention will become more clearly understood in connection with the detailed description of a preferred embodiment, when considered with the accompanying drawing, of which.

DETAILED DESCRIPTION OF THE PREFERRED EMBODIMENT

Figure 1:
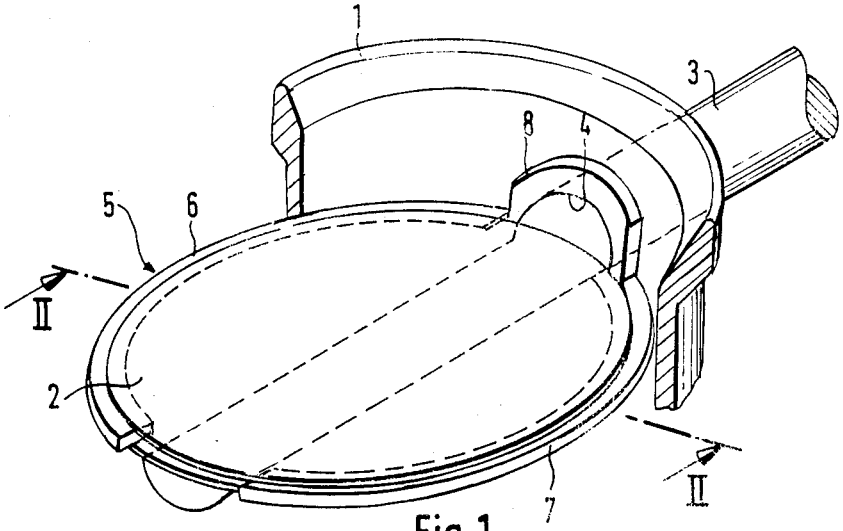
FIG. 1 is a perspective view of a part of a throttle-butterfly connector piece of the invention.

The throttle-butterfly connector piece shown in FIG. 1 has within a housing 1 a throttle butterfly 2 which is held by a setting shaft 3 which passes through a setting-shaft passage 4 in the housing 1.

From the circumferential surface of the throttle butterfly 2 there extends an expansion member 5 developed as spring cuff, the expansion member resting via the ends of two arcuate pieces 6, 7 against a setting surface 8 which surrounds the setting-shaft passage 4 and is arranged on the inside on the housing 1 coaxial to the setting shaft 3. This setting surface 8 is so developed that the arcuate pieces 6, 7 are spread upon an initial swinging motion of the throttle butterfly 2 and thereby move radially outward similar to the brake jaws of a drum brake.

Figure 2:
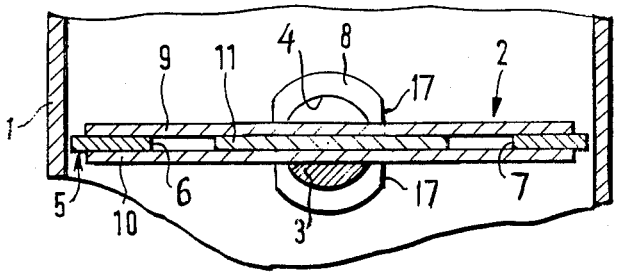
FIG. 2 is a section through the throttle butterfly of the throttle-butterfly connector piece along the line II—II of FIG. 1.

FIG. 2 shows that the throttle butterfly 2 is formed of two outer disks 9, 10 which are held spaced apart by a center piece 11. The expansion member 5 is secured between these outer disks 9, 10. FIG. 2 also shows the setting surfaces 8 by which the expansion member 5 is spread out so that it can increase the surface of the throttle butterfly 2 when the throttle butterfly 2 is swung in the opening direction.

Figure 3:
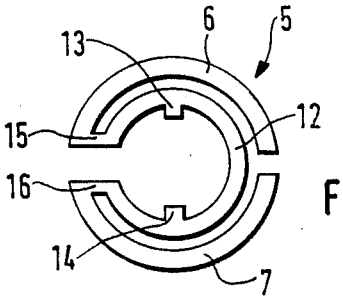
FIG. 3 is a top view of an expansion member of the throttle-butterfly connector piece.

The expansion member 5 may be of various forms of development, and may consist, for instance, of two individual semicircular arcuate pieces 6, 7 which are fastened on the throttle butterfly 2 on the side facing the setting surface 8. FIG. 3 shows a special embodiment of the expansion member 5 which has a ring-shaped member 12 which is not closed. This ring-shaped member 12 has two radially inward-directed projections 13, 14 which serve to prevent its turning on the throttle butterfly 2. From the free ends of the ring-shaped member 12 two expansion member arms 15, 16 extend radially outward, to which are connected the arcuate pieces 6, 7, the free ends of which, on their part, rest against the setting surface 8 shown in the preceding figures adjoining said arms.

Figure 4:
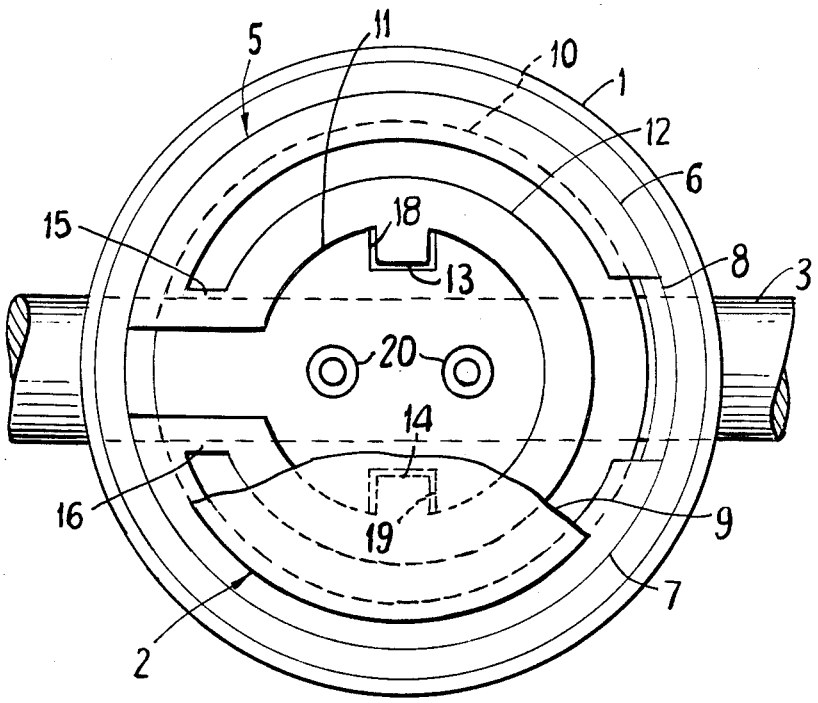
FIG. 4 is a plan view of the butterfly.

In the plan view of the throttle butterfly in FIG. 4, the upper disk 9 has been partially cut away to expose portions of the expansion member 5 and the center piece 11. The arcuate pieces 6 and 7 are shown in abutment with the setting surface 8, the free ends of the pieces 6 and 7 sliding along the surface 8 during rotation of the shaft 3. The surface 8 serves as a cam to urge the pieces 6, 7 apart during rotation of the shaft 3 away from the closed throttle position. The vertical sides 17 of the surface 8 follow the vertical interior sides of the housing 1 to maintain substantial registration of the outer peripheries of the pieces 6, 7 with the inner surface of the housing 1 for rotations up to approximately 20 degrees. The projections 13, 14 mate with notches 18, 19 of the center piece 11 for alignment therewith. Screws 20 secure the top disk 9, the center piece 11 and the bottom disk 10 to the shaft 3.

I claim:

1. In a throttle-butterfly valve for an internal combustion engine, the valve comprising a housing, a shaft rotatably supported by the housing, and a throttle butterfly which is held by the shaft for rotation in the housing; the improvement wherein the butterfly comprises an expansion element located in the region of the edge of the throttle butterfly, said expansion element, upon an opening of the throttle butterfly valve, moving out of the circumferential edge of the throttle butterfly as a function of angular position of the throttle butterfly.

2. A valve according to claim 1, wherein the housing includes a setting surface for setting an amount of expansion of the expansion element; and the expansion element is formed as a spring cuff having two arcuate pieces, which are movable out of the circumferential edge of the throttle butterfly and rest against the setting surface.

3. A valve according to claim 2, wherein the setting surface is arranged coaxial to the shaft, and on the inside of the housing.

4. A valve according to claim 1, wherein the housing includes a setting surface for setting an amount of expansion of the expansion element; and said expansion element comprises an inner, open, ring-shaped element which is secured within the throttle butterfly, two expansion arms extending radially outward from free ends of the ring-shaped element, and two arcuate pieces which adjoin respective ones of said arms and extend along the circumferential edge of the throttle butterfly and rest against the setting surface.

5. A valve according to claim 1, wherein the expansion element has a cross section which differs over its circumference.

6. A valve according to claim 1, wherein the housing includes a setting surface for setting an amount of expansion of the expansion element; and said expansion element comprises an inner, open, ring-shaped element which is secured within the throttle butterfly, two expansion arms extending radially outward from free ends of the ring-shaped element, and two arcuate pieces which adjoin respective ones of said arms and extend along the circumferential edge of the throttle butterfly and rest with free ends thereof against the setting surface.

* * * * *